US005679936A

United States Patent [19]

Schaeffer et al.

[11] Patent Number: 5,679,936

[45] Date of Patent: Oct. 21, 1997

[54] LATCHING CONTROL BUTTON, IN PARTICULAR FOR ACTUATING AN ELECTRICAL COMPONENT

[75] Inventors: Maurice Schaeffer; Fabien Fantini, both of Strasbourg, France

[73] Assignee: B A C O Constructions Electriques Anct. Baumgarten, Strasbourg, France

[21] Appl. No.: 659,928

[22] Filed: Jun. 7, 1996

[30] Foreign Application Priority Data

Jun. 13, 1995 [FR] France ..... 95 06963

[51] Int. Cl.[6] ..... H01H 3/00; H01H 3/20; H01H 27/00

[52] U.S. Cl. ..... 200/17 R; 200/539; 200/43.07

[58] Field of Search ..... 200/17 R, 43.07, 200/43.08, 43.11, 43.13, 43.16, 43.18, 520, 523, 538, 539, 526, 527, 528, 566

[56] References Cited

U.S. PATENT DOCUMENTS

| | | | |
|---|---|---|---|
| 4,634,822 | 1/1987 | Goeke | 200/43.08 |
| 5,384,442 | 1/1995 | Danner | 200/566 |
| 5,593,022 | 1/1997 | Schaeffer | 200/308 |

FOREIGN PATENT DOCUMENTS

| | | |
|---|---|---|
| 386844 | 9/1990 | European Pat. Off. . |
| 3533891 | 7/1986 | Germany . |

*Primary Examiner*—Michael L. Gellner
*Assistant Examiner*—Michael J. Hayes
*Attorney, Agent, or Firm*—Young & Thompson

[57] ABSTRACT

The plunger of a latching control button is held in its retracted position by a latching ring which is rotatable about the axis of the system and releases the plunger when the control member is depressed.

17 Claims, 5 Drawing Sheets

LATCHING CONTROL BUTTON, IN PARTICULAR FOR ACTUATING AN ELECTRICAL COMPONENT

BACKGROUND OF THE INVENTION

1. Field of the Invention

The present invention concerns latching control buttons of the type that are used, for example, to stop a machine quickly and permanently in an emergency.

2. Description of the Prior Art

Usually called "mushroom head pushbuttons" because their shape is such that they can be actuated with the palm of the hand, these control buttons usually include, in a coaxial arrangement, a guide body by means of which they can be mounted on any kind of support, and which is therefore fixed, a plunger to actuate an underlying component of some kind controlling the machine, axially mobile in the guide body in the manner of a piston between a retracted position and an advanced position, latching means on the path of movement of the plunger and retractable to release it so that they releasably retain it in at least one axial direction, a control member in the general shape of a mushroom axially mobile in the guide body between an "out" inactive position and an "in" active position and having a head to be actuated by the user and a shank to actuate the plunger, return spring means which urge the control member at all times towards its "out" inactive position and, operative between the plunger and the control member, lost motion coupling means enabling the control member to apply traction to the plunger in the axial direction opposite that in which it operates on the underlying component, enabling the control member to return the plunger to its retracted position as it is itself returned to its "out" inactive position.

The latching means usually operate on the plunger in the axial direction from its advanced position, in which it operates on the underlying component, to its retracted position, in which it is moved away from the latter, i.e. in the axial direction from the "in" active position to the "out" inactive position of the control member.

Thus when the control member is depressed and drives the plunger into the advanced position so that it operates the underlying component it controls, for example switching the latter from a closed state to an open state, the plunger locates under the latching means and, thereafter retained by the latter, holds the underlying component in the open state and the control member in the "in" active position.

Usually, to return the underlying component to its initial closed state, i.e. to bring about the reverse switching of this component from one state to the other, sufficient traction must be applied to the control member for the latter to return the plunger from its advanced position to its retracted position and thereby release the component.

In practise, however, given the travels available, the plunger can actuate the underlying component before it passes the latching means.

In other words, the underlying component may be switched from the closed state to the open state before the plunger (and therefore the control member) are latched.

Consequently, if the control member is released before latching takes place, the underlying component inevitably returns to its initial closed state, after being temporarily switched to the open state in the meantime.

In other words, the required emergency stop action is only temporary, which is unsafe.

An object of the present invention is an arrangement which has the advantage that, once established, the emergency stop action is permanent, as well as other advantages.

SUMMARY OF THE INVENTION

To be more precise, the present invention consists in a control button of the kind comprising, in a coaxial arrangement about an axis, a guide body adapted to be mounted on some kind of support, and which is therefore fixed, a plunger mobile axially within said guide body in the manner of a piston between a retracted position and an advanced position to operate an underlying component of some kind, latching means on the path of movement of said plunger which can be retracted for releasable retention of said plunger in at least one axial direction, a control member mobile axially relative to said guide body between an "out" inactive position and an "in" active position and including a head to be operated by a user and a shank for operating said plunger, return spring means adapted to urge said control member at all times towards its "out" inactive position, and, operative between said plunger and said control member, lost motion coupling means whereby said control member can apply traction to said plunger in the axial direction opposite that in which it operates on the underlying component, wherein said coupling means comprise, firstly, a coupling ring rotatable relative to said guide body, axially keyed thereto and carrying at least one radially projecting pin and, secondly, two tracks with which said pin is simultaneously engaged, one on said plunger and the other on said shank of said control member, said plunger being itself rotatable about said axis, said button further comprising, associated with said plunger, firstly, axial bias spring means adapted to urge it towards its advanced position and, secondly, circular bias spring means urging it at all times towards an angular rest position, and unlatching means under the control of said user adapted to impart relative rotation to said plunger and/or said control member.

With this arrangement, the plunger is temporarily retained by the latching means while the control member is being depressed, which prevents it operating the underlying component prematurely; the latching means operate on the plunger in the axial direction from its retracted position to its advanced position, i.e. from the "out" inactive position of the control member to its "in" active position, in other words, the axial direction opposite that used in the prior art.

The axial travel of the control member can therefore be sufficient for the axial bias spring means associated with the plunger to be progressively stressed while the plunger is temporarily retained by the latching means.

When the control member causes the latching means to release the plunger, the axial bias spring means associated with the plunger propel it towards the underlying component, operating it as previously, for example switching it from its closed state to its active state.

If the control member is released at any time after this, the latching ring of the latching means in accordance with the invention retains it in the "in" active position, the track through which it cooperates with the pin on the latching ring being designed accordingly.

In other words, using the arrangement of the invention, from the moment at which the latching means release the plunger, at which time the latter has definitely caused the underlying component to change state, unintentional release of the control member has no effect on the resulting open state of the component.

Unlike those of the prior art arrangements, the latching means of the invention act first on the plunger, in a first axial direction, to prevent it moving towards the underlying component that it is to operate, and subsequently on the control member, in the opposite axial direction, to retain the control member against the action of the return spring means urging it towards its "out" inactive position, so that the device is latched in the "in" active position.

In accordance with the invention, and again differing from the prior art, unlatching entails the use of means adapted to bring about rotation of the plunger and/or the control member relative to each other.

In some applications at least, the unlatching means comprise, for example, a rod having a non-circular cross-section that is inserted axially in a bore having a complementary cross-section provided for this purpose in the plunger and can, if required, be freely accessible to the user.

In other applications, however, they can be operated by a key.

In this case, unlatching the control button to return it to "out" inactive position and thereby return the underlying component that it controls to the closed state requires the intervention of the authorized keyholder.

This can be, for example, a qualified safety officer responsible for verifying whether the machine concerned is in a fit condition to be restarted.

The keyholder could equally be a foreman responsible for verifying that the emergency stopping of the machine was justified.

The features and advantages of the invention will emerge further from the following description given by way of example with reference to the appended diagrammatic drawings.

BRIEF DESCRIPTION 0F THE DRAWINGS

Figure 6:
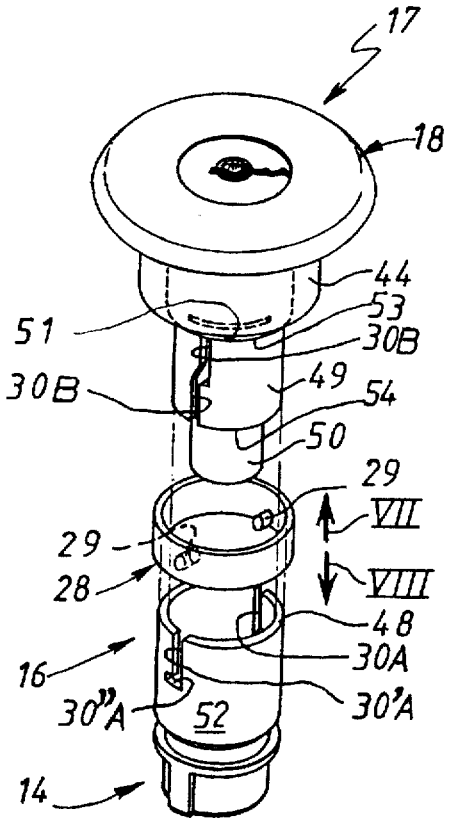
FIG. 6 is a perspective view of some components of the control button of the invention, also to a different scale.
Figure 8:
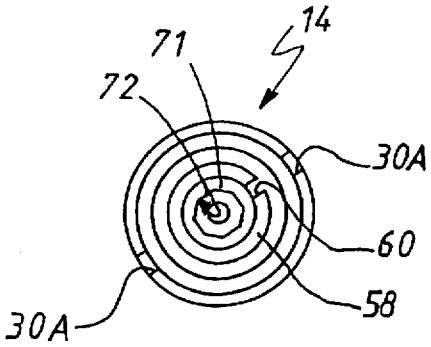

FIG. 8 a top view of another of these components, as seen in the direction of the arrow VIII in FIG. 6.

Figure 4:
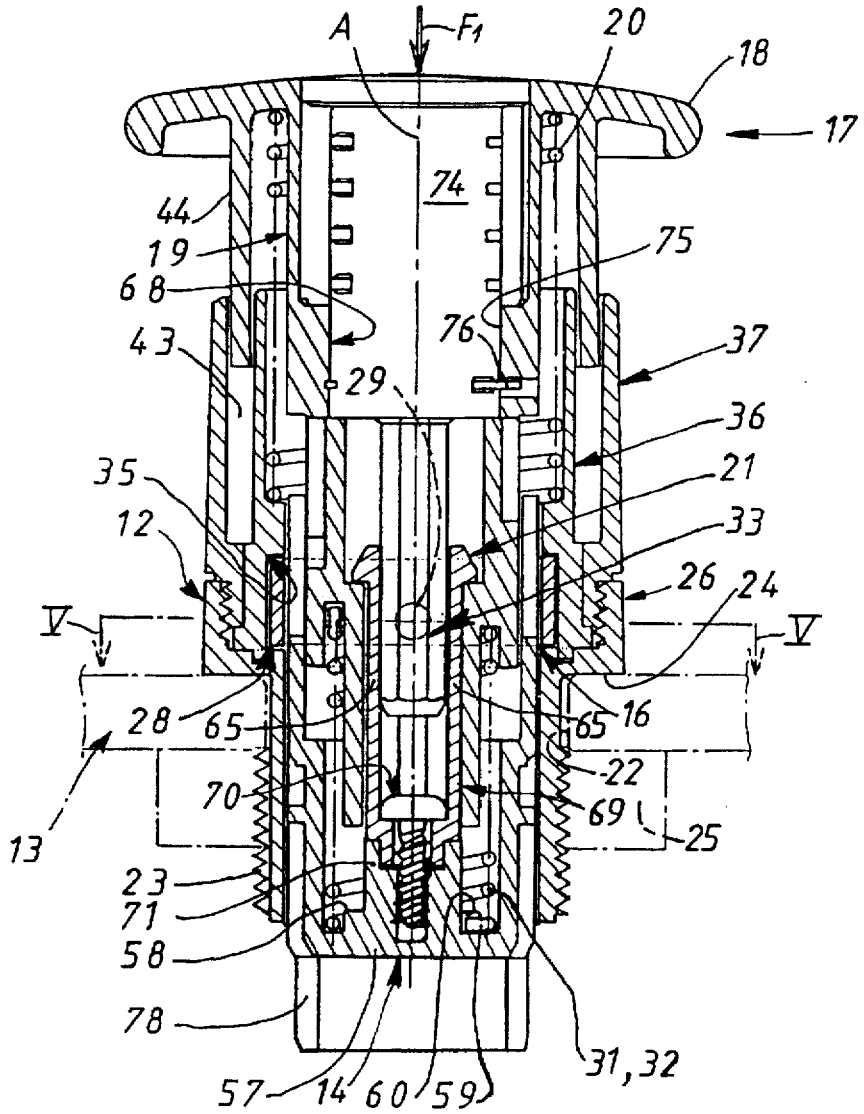
FIG. 4 is an axial section of the button to a larger scale.
Figure 5:
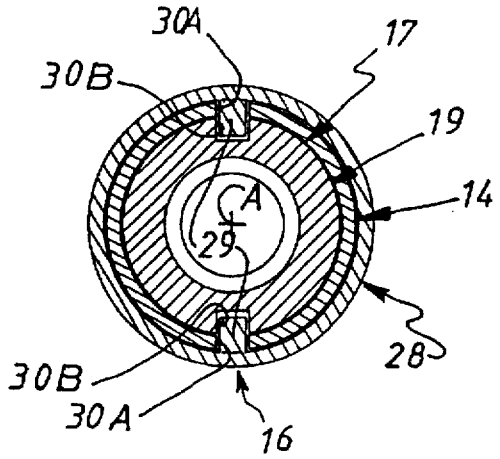
FIG. 5 is a view of only some of its components, in section on the line V—V in FIG. 4.
Figure 9A:
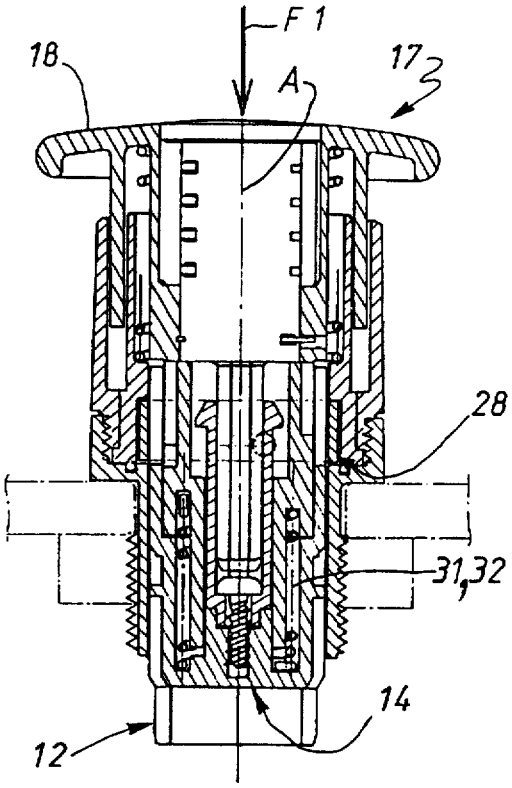
Figure 9B:
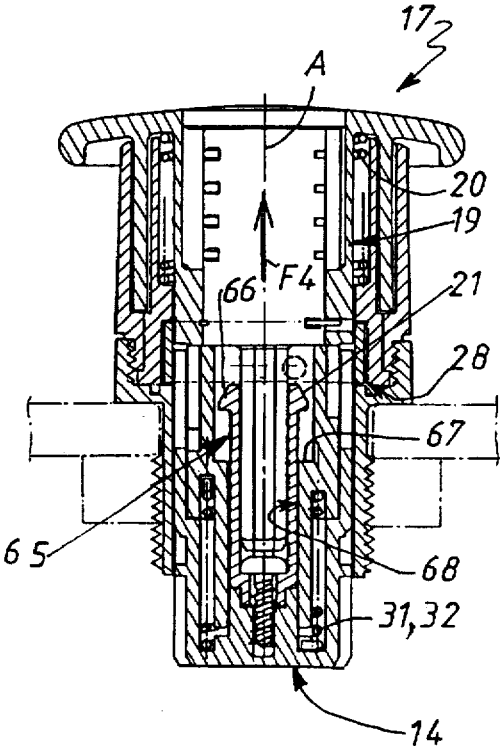
Figure 9C:
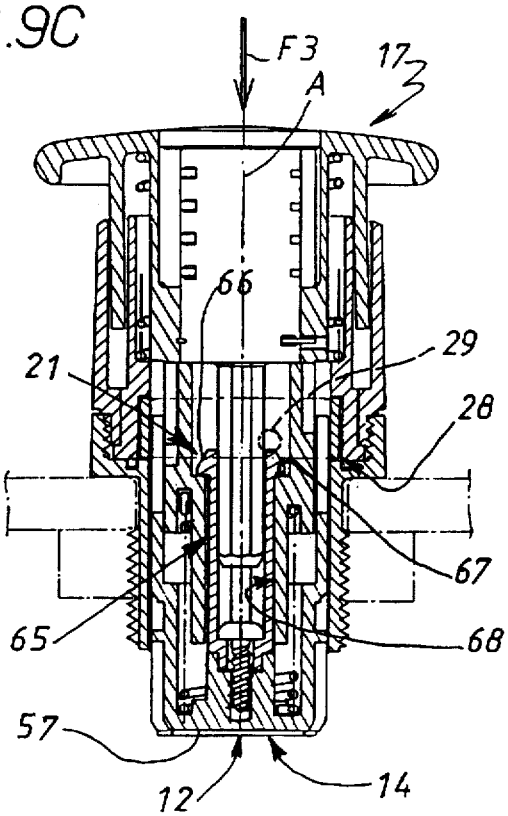

FIGS. 9A, 9B, 9C are cross-sections analogous to that of FIG. 4 showing various phases in the operation of the control button of the invention.

Figure 10:
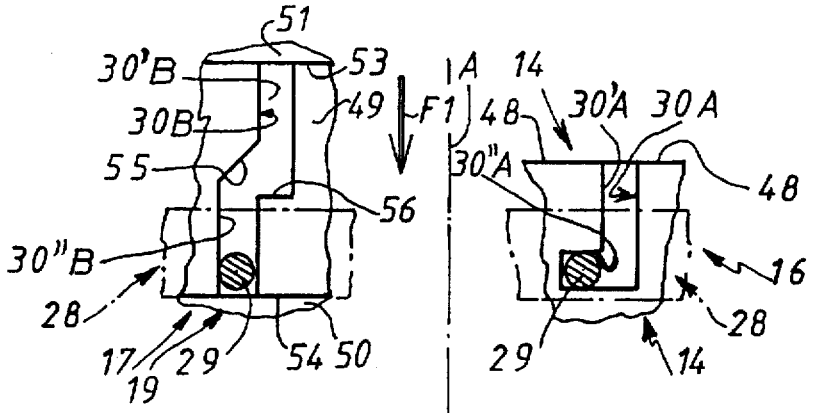
Figure 10:
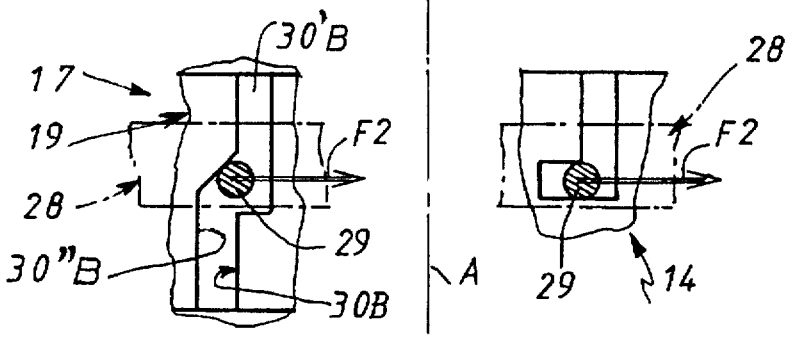
Figure 10A:
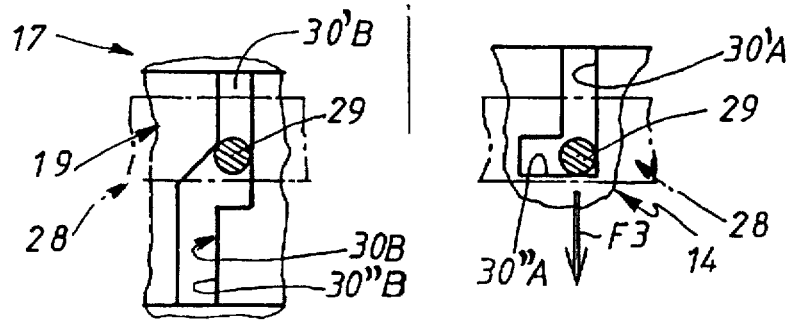
Figure 10B:
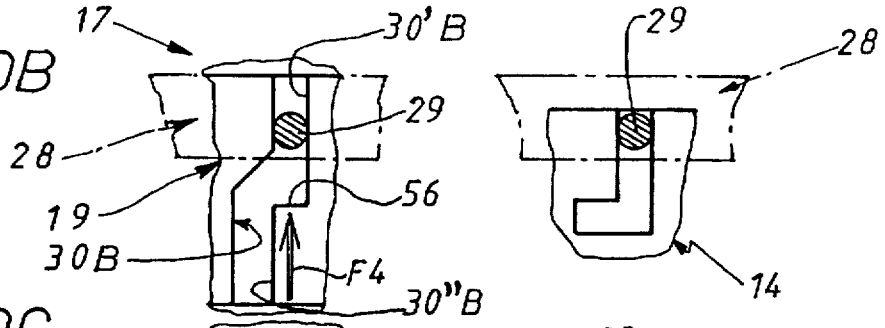
Figure 10C:
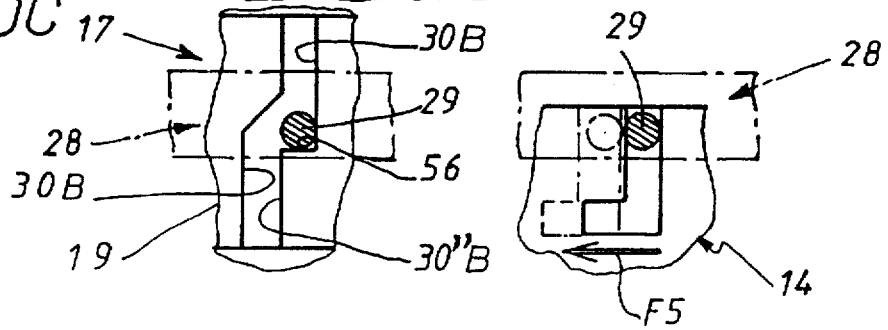

FIGS. 10, 10', 10A, 10B, 10C are diagrams also showing various phases of this operation, FIGS. 10A, 10B, 10C respectively corresponding to FIGS. 9A, 9B, 9C.

DETAILED DESCRIPTION OF THE PREFERRED EMBODIMENT

Figure 1:
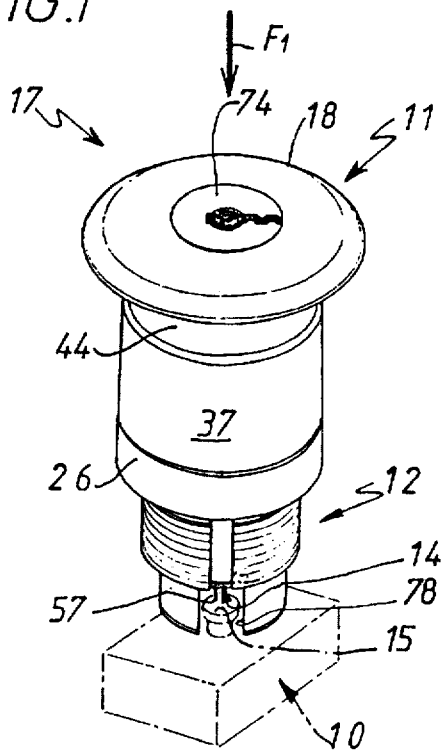
FIG. 1 is a perspective view of a control button in accordance with the invention, showing the control member in the "out" inactive position.
Figure 2:
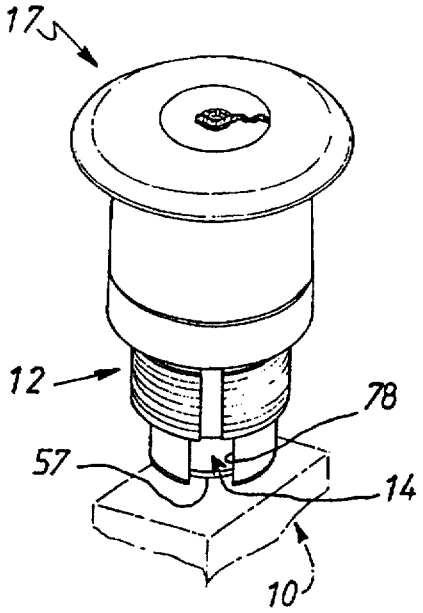
FIG. 2 is a perspective view of the button showing the control member in its "in" active position.
Figure 3:
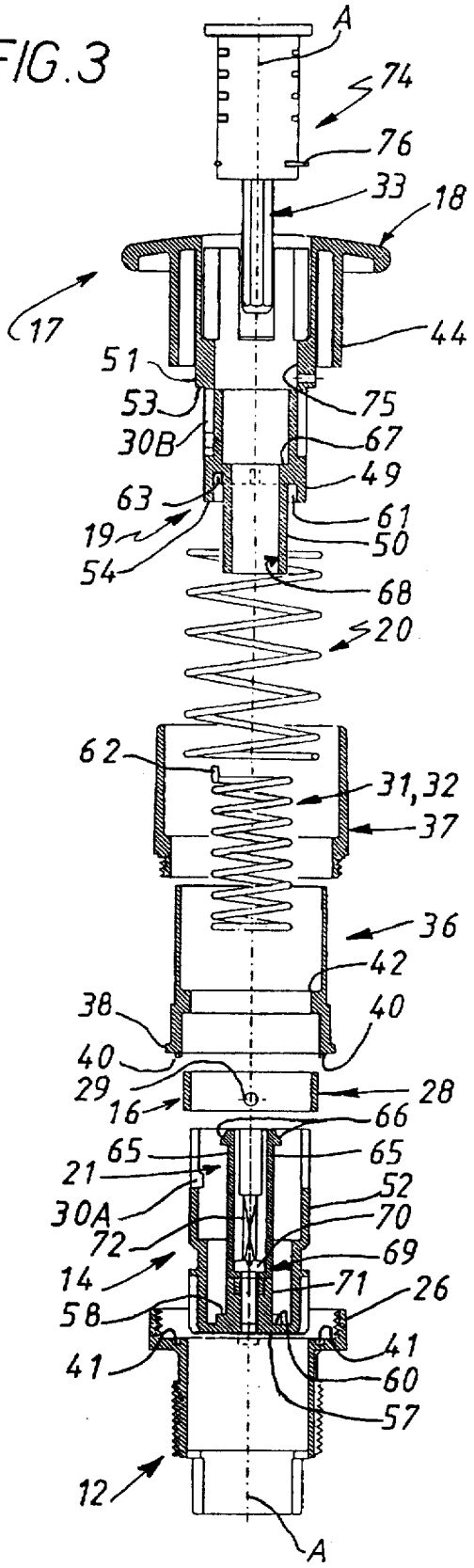
FIG. 3 is an exploded axial cross-section of the button.

As shown diagrammatically in FIGS. 1 and 2, the overall aim is to actuate a component 10 of some kind, for example an electrical component of some kind, such as a switch, for stopping a machine in an emergency, to change the state of the component 10, i.e. to switch it from one state to another, for example to switch it from a closed state to an open state.

As the component 10 is not of itself part of the present invention it will not be described here and it is shown only diagrammatically in FIGS. 1 and 2, by its outline.

The component 10 is actuated by a control button 11 including, in a coaxial arrangement about an axis A, a guide body 12 by means of which it is mounted on a support 13 of some kind, as shown diagrammatically in chain-dotted outline in FIG. 4, a plunger 14 which is axially mobile, in the manner of a piston, in the guide body 12 between a retracted position shown in FIGS. 4 and 9A and an advanced position shown in FIGS. 9B and 9C to actuate the underlying component 10, to be more precise a nipple 15 on the latter, latching means 16 on the path of movement of the plunger 14 which are retractable, as described in more detail below, to retain the plunger 14 releasably in at least one axial direction, a control member 17 axially mobile in the guide body 12 between an "out" inactive position shown in FIGS. 1 and 4 and an "in" active position shown in FIGS. 2 and 9C, having a head 18 to be actuated by the user and a shank 19 for actuating the plunger 14, return spring means 20 which urge the control member 17 at all times towards its "out" inactive position and, operative between the plunger 14 and the control member 17, lost motion coupling means 21 which, as described in more detail below, enable the control member 17 to apply traction to the plunger 14 in the axial direction opposite to that in which it acts on the underlying component 10.

As shown diagrammatically in chain-dotted outline in FIG. 4, the support 13 is a simple plate with a hole 22 in it in which a screwthreaded portion 23 of the guide body 12 is engaged, for example.

A shoulder 24 on the guide body 12 bears against one side of the support 13 and a nut 25 screws onto the screwthreaded portion 23 on the opposite site to fasten it to the support 13.

The shoulder 24 on the guide body 12 is in practise formed by the bottom surface of a radial enlargement 26 of the guide body 12.

In accordance with the invention, the latching means 16 include a latching ring 28 rotatable relative to the guide body 12 but keyed to it in the axial direction and carrying at least one radially projecting pin 29, and two tracks 30A, 30B with which the pin 29 is simultaneously engaged, one on the plunger 14 and the other on the shank 19 of the control member 17.

The plunger 14 is itself rotatable about the axis A.

The plunger 14 is associated with axial bias spring means 31 adapted to urge it towards its advanced position, and thus towards the underlying component 10, and circular bias spring means 32 which urge it at all times towards an angular rest position, as shown in the figures, and unlatching means 33 under the control of the user allow relative rotation about the axis A to be imparted to the plunger 14 and/or the control member 17.

In the embodiment shown the latching ring 28 is axially co-located with the radial enlargement 26 on the guide body 12 and accommodated in a housing 35 defined partly by the guide body 12 and partly by a bush 36 keyed to the latter in the axial and circumferential directions.

The bush 36 in practise bears in the axial direction on a flange 37 screwed onto the radial enlargement 26 of the guide body 12.

To this end the bush 36 has an annular rim 38 projecting radially from the bottom end of its outside surface clamped axially between the guide body 12 and the flange 37.

It also has at least two pins 40 projecting from its bottom edge, engaged with corresponding recesses 41 on the guide body 12 so that it and the latter are locked together in the circumferential direction.

The bush 36 also has, equidistant from its top and bottom edges, an annular band 42 projecting radially from its inside surface, the bottom face of which delimits the housing 35 in the latching ring 28 and the top face of which has the return spring means 20 of the control member 17 bearing on it.

In practise, the return spring means 20 comprise a compression coil spring around the shank 19 of the control member 17, its other end bearing on the bottom surface of the head 18 of the latter.

In the embodiment shown the flange 37 is radially spaced from and outside the bush 36, and thus delimits with the bush 36 an annular space 43, and the control member 17 has a skirt 44 inserted axially into this annular space 43, the skirt projecting from the bottom surface of its head 18, around and spaced from its shank 19.

Figure 7:
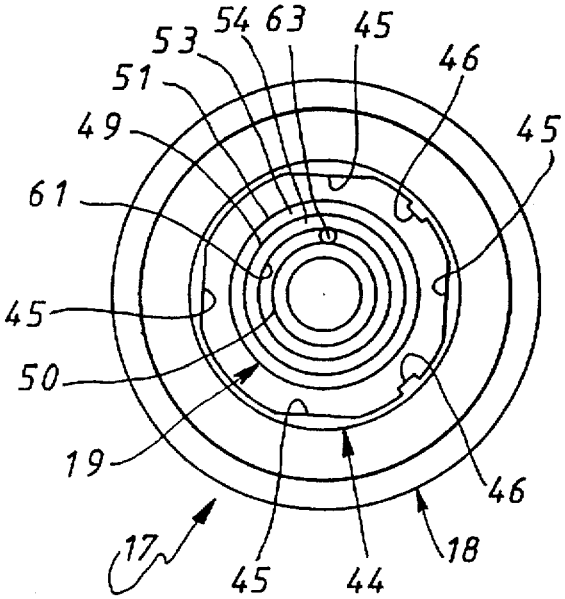
FIG. 7 is a bottom view of one of these components, as seen in the direction of the arrow VII in FIG. 6.

As can be seen in FIG. 7, the skirt 44 has flats 45, four such flats in the embodiment shown, on its bottom surface for guiding it and constraining it to rotate with the bush 36, the bush 36 having the same number of complementary flats (not visible in the figures).

Similarly, the skirt 44 of the control member 17 has at least one polarizer rib 46 projecting from its inside surface and engaging with a complementary groove provided for this purpose on the outside surface of the bush 36.

In practise there are two such ribs 46 with an angular separation between them.

In practise there are four flats 45 in the embodiment shown.

In the embodiment shown, the latching ring 28 surrounds the plunger 14, which is hollow and in turn surrounds the shank 19 of the control member 17, with the result that the pin 29 on the latching ring 28 passes through the track 30A, i.e. through the plunger 14.

In this embodiment the pin 29 therefore projects beyond the inside surface of the latching ring 28.

The latching ring 28 has two diametrally opposite pins 29 in practise and the plunger 14 and the shank 19 of the control member 17 therefore each comprise two tracks (30A for the plunger 14 and 30B for the shank 19 of the control member 17).

In the embodiment shown the pins 29 on the latching ring 28 have a circular cross-section and the width between the flanks of the tracks 30A, 30B on the plunger 14 and the shank 19 of the control member 17 is slightly greater than their diameter.

As can be seen more clearly in the case of one of them in FIG. 10, each of the tracks 30A on the plunger 14 has two sections 30'A, 30"A which merge and comprise a longitudinal section 30'A parallel to the axis A running from the top edge 48 of the plunger 14 and a transverse section 30"A perpendicular to the axis A, at a distance from the top edge 48.

The section 30"A of the track 30A perpendicular to the axis A of the system is a dead-end to define the angular rest position of the plunger 14.

The tracks 30B in a middle portion 49 of the shank 19 of the control member 17 have a diameter between that of a smaller diameter bottom section 50 and a larger diameter top section 51.

The tracks 30A on the plunger 14 are slots, since they pass through the plunger 14, to be more precise through its tubular wall 52, and the tracks 30B on the shank 19 of the control member 17 are grooves on the outer surface of the middle section 49 of the shank 19.

In practise the tracks 30B extend the full height of the middle section 49.

They therefore extend from a blind end at the shoulder 53 at the top of the middle section 49 to an open end at the shoulder 54 at the bottom of the middle section 49.

Each of the tracks 30B on the shank 19 of the control member 17 has two sections 30'B, 30"B which merge together and run in the axial direction from the head 18 of the control member 17 to the plunger 14, i.e. from top to bottom as shown in the figures; they are both parallel to the axis A and they are circumferentially offset from each other. Where the sections 30'B, 30"B merge, there is on one flank a release facet 55 oblique to the axis A.

The release facet 55 is in practise at substantially 45° to the axis A.

Where the two sections 30'B, 30"B merge, there is additionally on the other flank of each of the tracks 30B a retaining facet 56 perpendicular to the axis A.

In practise the retaining facet 56 extends beyond the release facet 55 in the axial direction from the head 18 of the control member 17 to the plunger 14.

In other words, it is farther away from the head 18 of the control member 17 than the release facet 55.

In the embodiment shown, the axial bias spring means 31 and the circular bias spring means 32 associated with the plunger 14 are provided by one and the same spring, a compression and torsion coil spring with one end attached to the plunger 14 and the other end attached to the shank 19 of the control member 17.

In practise the spring 31, 32 bears on an end wall 57 closing the bottom end of the plunger 14, around a boss 58 for centering it projecting from this end wall 57.

As can be seen in FIG. 4, its corresponding end 59 is bent at a right-angle towards the axis A and engaged in a notch 60 provided for this purpose on the boss 58.

The top end of the spring 31, 32 surrounds the bottom section 50 of the shank 19 of the control member 17 and is centered by an annular groove 61 provided for this purpose on the shoulder 54 at the bottom of the middle section 49 of the shank 19.

An end 62 of the spring 31, 32 bent at a right-angle parallel to the axis A engages in a housing 63 in the bottom of the groove 61.

In the embodiment shown the shank 19 of the control member 17 is hollow and the lost motion coupling means 21 between the plunger 14 and the shank 19 include at least one coupling lug 65 attached to the plunger 14, elastically deformable in the radial direction and running parallel to the axis A of the system, forming a hook 66 at its free end adapted to engage a transverse shoulder 67 provided for this purpose in the internal bore 68 of the shank 19 of the control member 17.

Two coupling lugs 65 are provided in practise, at diametrally opposite positions inside the plunger 14.

In the embodiment shown they are parts of a member 69 which is axially attached to the plunger 14 by a screw 70, at the end of an upstand 71 projecting axially from the boss 58 on its end wall 57.

However, the two coupling lugs 65 could obviously be in one piece with the plunger 14.

In the embodiment shown, the unlatching means 33 rotate the plunger 14 only, to move it temporarily away from its rest position, and comprise a rod having a non-circular cross-section, for example a hexagonal cross-section as shown here. The plunger 14 has an axial bore 72 with a complementary cross-section to cooperate with the rod.

The bore 72 is in practise between the coupling lugs 65.

In other words, the coupling lugs 65 flank the bore 72.

They are therefore braced by the rod forming the unlatching means 33, which prevents them escaping from the shoulder 67 on the shank 19 of the control member 17.

In the embodiment shown the unlatching means 33 are operated by a lock 74 accessible to the user.

In practise the lock 74 is disposed in a housing 75 formed by the upper part of the internal bore 68 in the shank 19 of the control member 17, which is widened for this purpose.

It therefore opens onto the central part of the front face of the head 18 of the control member 17.

The lock 74 is naturally keyed axially and circumferentially into its housing 75 by a retaining member 76 operating like a pin and formed by one of its disks (usually called tumblers), for example.

In the "out" inactive position of the control member 17 shown in FIG. 4 the coupling lugs 65 of the plunger 14 are engaged with the shoulder 67 on the shank 19 of the control member 17 and the spring constituting the return spring means 20 of the latter is preferably slightly prestressed, although it can be relaxed if required.

At the same time, the spring constituting the axial bias spring means 31 and the circular bias spring means 32 associated with the plunger 14 is relaxed or slightly prestressed.

As shown in the case of one of them in FIG. 10, in this "out" inactive position of the control member 17 the lugs 29 on the latching ring 28 are engaged, firstly, with the transverse section 30"A of the tracks 30A on the plunger 14, with the result that the plunger 14 is held axially in the retracted position, at a distance from the underlying component 10, and, secondly, with the bottom section 30"B of the tracks 30B on the shank 19 of the control member 17.

The associated circular bias spring means 32 push the plunger 14 against the lugs 29 on the latching ring 28 through the end wall of the transverse section 30"A of its tracks 30A, which defines its angular rest position.

As shown in FIGS. 1 and 4, the end wall 57 of the plunger 14 is then in practise a relatively large distance from the free end of the guide body 12, which in the embodiment shown is open laterally via two slots 78.

The latching ring 28 is in practise free to rotate, with slight clearance, in its housing 35 and is circumferentially locked to the shank 19 of the control member 17 by its pins 29, so that the plunger 14 is permanently retained.

Assume now that the control member 17 is depressed, in the direction of the arrow F1 in FIGS. 1, 4, 9A and 10.

Initially the control member 17 moves down in the guide body 12, with no particular effect, the latching ring 28 being held in position by the bottom section 30"B of its tracks 30B.

The situation prevails until, as shown in FIG. 10', the release facet 55 of the tracks 30B comes into contact with the pins 29 on the latching ring 28.

Because the release facet 55 is oblique, as the control member 17 is depressed further the transverse component of the axial force acts on the pins 29 of the latching ring 28 which is constrained to rotate about the axis A, as shown by the arrow F2 in FIG. 10'.

This rotation causes the pins 29 on the latching ring 28 to move into the top section 30'B of the tracks 30B on the shank 19 of the control member 17, as shown in FIG. 10A, and after traveling along the transverse section 30"A of the tracks 30A of the plunger 14 they simultaneously arrive at the longitudinal section 30'A of the tracks 30A, as also shown in FIG. 10A.

The latching means 16 are therefore "retracted", as it were, the plunger 14 is released and the associated axial bias spring means 31, which were progressively stressed elastically by the control member 17 as it was depressed, cause it to move suddenly from its previous retracted position, as shown in FIG. 9A, to the advanced position, shown in FIG. 9B, as shown by the arrow F3 in FIGS. 9A and 10A, in which position it operates the underlying component 10, to be more precise the nipple 15 of the latter, causing the component 10 to change state, in practise causing it to change from its closed state to its open state.

The pins 29 on the latching ring 28 are then level with the retaining facet 56 on the tracks 30B of the shank 19 of the control member 17, however.

Thus if the control member 17 is released and begins to move back towards its "out" inactive position, as shown by the arrow F4 in FIGS. 9B and 10B, due to the action of the return spring means 20 that are now stressed elastically, its retaining facet 56 hooks onto the pins 29 on the latching ring 28, as shown in FIGS. 9C and 10C.

The control member 17 is then held in the "in" active position by the latching ring 28 and because the axial bias spring means 31 are elastically stressed by the control member 17 the plunger 14 remains in the advanced position, holding the underlying component 10 in its new state.

Because of the lost motion coupling means 21, the return movement of the control member 17, at the end of which the shoulder 67 in the internal bore 68 of its shank 19 engages with the hooks 66 of the coupling lugs 65 on the plunger 14, moves the plunger 14 back a short way, as can be seen by comparing FIGS. 9B and 9C, but this movement is insufficient to change the state of the underlying component 10, which therefore remains in the open state.

In the retracted position the plunger 14 is substantially flush with the free end of the guide body 12, as shown.

To unlatch the device and thereby enable the underlying component 10 to return to the closed state, the unlatching means 33 must be operated using a key (not shown).

Inserted into the lock 74, the key rotates the rod constituting the unlatching means 33 which rotates the plunger 14 relative to the control member 17, against the associated circular bias spring means 32, in the direction of the arrow F5 in FIG. 10C.

This rotation temporarily moves it from the angular rest position shown in continuous line in FIG. 10C to another angular position, offset angularly from the former position and shown diagrammatically in chain-dotted line in FIG. 10C, and the plunger 14 rotates the latching ring 28 in the same direction, the pins 29 on the latter being engaged with the longitudinal section 30'A of the tracks 30A.

As a result the pins 29 reach the bottom section 30"B of the tracks 30B on the shank 19 of the control member 17, which releases the latter.

Its return spring means 20 return the control member 17 to the "out" inactive position and return the plunger 14 to the retracted position via the lost motion coupling means 21.

Temporarily moved away from its angular rest position by the unlatching means 33, as previously mentioned, the plunger 14 is returned to this angular rest position by the associated circular bias spring means 32 as soon as the rotation previously imparted to the unlatching means 33 is released.

The rotation of the plunger 14 needed to bring about unlatching is preferably relatively large, for example approximately 30° to 50°, so that unlatching cannot happen unintentionally, through fumbling with the key.

To bring this about a dead space in which it has no effect can be provided at the start of this rotation, for example.

Of course, the present invention is not limited to the embodiment described and shown, but encompasses any variant execution thereof.

In particular, in a simplified embodiment of the invention the unlatching means are not operated by a lock.

In this case they are limited to a rod adapted to rotate the plunger, whether the rod remains in the control button at all times or can be removed from it, in which case the accessible part of the rod can be of any shape, for example a shape similar to that of the head of the control member, taking the place of the latter.

Further, unlatching can be brought about by rotating the control member, rather than the plunger, in particular if the unlatching means are not operated by a lock.

There is claimed:

1. Control button of the kind comprising, in a coaxial arrangement about an axis, a guide body mounted on a support, and which is therefore fixed, a plunger mobile axially within said guide body in the manner of a piston between a retracted position and an advanced position to operate an underlying component, latching means on the path of movement of said plunger which can be retracted for releasable retention of said plunger in at least one axial direction, a control member mobile axially relative to said guide body between an "out" inactive position and an "in" active position and including a head to be operated by a user and a shank for operating said plunger, return spring means that urge said control member at all times towards its "out" inactive position, and, operative between said plunger and said control member, lost motion coupling means whereby said control member can apply traction to said plunger in the axial direction opposite that in which it operates on the underlying component, wherein said coupling means comprise, firstly, a coupling ring rotatable relative to said guide body, axially keyed thereto and carrying at least one radially projecting pin and, secondly, two tracks with which said pin is simultaneously engaged, one on said plunger and the other on said shank of said control member, said plunger being itself rotatable about said axis, said button further comprising, associated with said plunger, firstly, axial bias spring means that urge said plunger towards its advanced position and, secondly, circular bias spring means urging said plunger at all times towards an angular rest position, and unlatching means under the control of said user to impart relative rotation to said plunger and said control member.

2. Control button according to claim 1 wherein said track on said shank of said control member has two sections parallel to said axis which merge and are circumferentially offset relative to each other, with a release facet oblique to said axis on one flank where said two sections merge.

3. Control button according to claim 2 wherein said track on said shank of said control member has a retaining facet perpendicular to said axis on the other flank where said two sections merge.

4. Control button according to claim 2 wherein said track on said shank of said control member has a retaining facet perpendicular to said axis on the other flank where said two sections merge and said retaining facet extends beyond said release facet in the axial direction from said head of said control member to said plunger.

5. Control button according to claim 1 wherein said track on said plunger has two sections which merge, one of which is parallel to said axis and the other of which is perpendicular thereto.

6. Control button according to claim 5 wherein said section of said track on said plunger perpendicular to said axis of said system is a dead-end.

7. Control button according to claim 1 wherein said coupling ring surrounds said plunger which in turn surrounds said shank of said control member so that said pin that it carries passes through said plunger via said track therein.

8. Control button according to claim 1 wherein said coupling ring carries two diametrally opposite pins and, in corresponding relationship, said plunger and said shank of said control member each comprise two tracks.

9. Control button according to claim 1 wherein said axial bias spring means and said circular bias spring means of said plunger comprise one and the same compression and torsion spring which has one end attached to said plunger and the other end attached to said shank of said control member.

10. Control button according to claim 1 further comprising unlatching means controlled by a lock.

11. Control button according to claim 10 wherein said unlatching means impart rotation to said plunger so that it is temporarily moved away from its angular rest position.

12. Control button according to claim 11 wherein said unlatching means comprise a rod having a non-circular cross-section and said plunger has an axial bore with a complementary cross-section to cooperate with said rod.

13. Control button according to claim 12 wherein said lost motion coupling means between said plunger and said shank of said control member include at least one coupling lug attached to said plunger, elastically deformable in the radial direction and parallel to said axis, said coupling lug flanking said bore in said plunger and therefore being braced by said rod constituting said unlatching means.

14. Control button according to claim 1 wherein said coupling ring is disposed in a housing defined partly by said guide body and partly by a bush axially keyed thereto.

15. Control button according to claim 14 wherein said bush is retained axially by a flange attached to said guide body.

16. Control button according to claim 15 wherein said flange is radially spaced from said bush and said control member includes a skirt inserted axially in the resulting annular space.

17. Control button according to claim 14 wherein said return spring means of said control member bear on said bush.

* * * * *